US008245491B2

(12) United States Patent
Horek et al.

(10) Patent No.: US 8,245,491 B2
(45) Date of Patent: Aug. 21, 2012

(54) HEAT RECOVERY SYSTEM AND METHOD

(75) Inventors: Jon Horek, Evanston, IL (US); Michael J. Wilson, Racine, WI (US); Mark Voss, Franksville, WI (US)

(73) Assignee: Modine Manufacturing Company, Racine, WI (US)

( * ) Notice: Subject to any disclaimer, the term of this patent is extended or adjusted under 35 U.S.C. 154(b) by 1273 days.

(21) Appl. No.: 11/939,906

(22) Filed: Nov. 14, 2007

(65) Prior Publication Data

US 2008/0115922 A1 May 22, 2008

Related U.S. Application Data

(60) Provisional application No. 60/859,192, filed on Nov. 15, 2006, provisional application No. 60/860,272, filed on Nov. 21, 2006.

(51) Int. Cl.
*F02C 6/00* (2006.01)

(52) U.S. Cl. ..... 60/39.182

(58) Field of Classification Search ..... 60/39.182, 60/39.511; 123/673, 676; 165/104.31, 240
See application file for complete search history.

(56) References Cited

U.S. PATENT DOCUMENTS

| | | | | |
|---|---|---|---|---|
| 1,572,886 | A | 2/1926 | Crandall et al. | |
| 2,113,559 | A * | 4/1938 | Abendroth | 122/448.4 |
| 3,769,795 | A * | 11/1973 | Rostrom | 60/665 |
| 3,968,775 | A * | 7/1976 | Harpman | 123/25 B |
| 4,509,464 | A | 4/1985 | Hansen | |
| 4,622,275 | A | 11/1986 | Noguchi et al. | |
| 4,685,426 | A * | 8/1987 | Kidaloski et al. | 122/214 |
| 4,819,437 | A * | 4/1989 | Dayan | 60/673 |
| 4,870,816 | A * | 10/1989 | Nakhamkin | 60/772 |
| 4,875,436 | A * | 10/1989 | Smith et al. | 122/7 R |
| 4,896,496 | A * | 1/1990 | Zervos | 60/772 |
| 5,360,679 | A | 11/1994 | Buswell et al. | |
| 5,549,927 | A | 8/1996 | Cottone et al. | |

(Continued)

FOREIGN PATENT DOCUMENTS

DE 102007056113 7/2008

(Continued)

OTHER PUBLICATIONS

PCT/US2005/008419 International Search Report, 5 pages, Dated Aug. 8, 2005.

*Primary Examiner* — Louis Casaregola
*Assistant Examiner* — Phutthiwat Wongwian
(74) *Attorney, Agent, or Firm* — Michael Best & Friedrich LLP

(57) ABSTRACT

An exhaust gas waste heat recovery heat exchanger includes a housing having a working fluid inlet, a working fluid outlet, an exhaust inlet, and an exhaust outlet, an exhaust flow path extending through the housing between the exhaust inlet and the exhaust outlet, and a working fluid flow path extending through the housing between the working fluid inlet and the working fluid outlet and having a first portion and a second portion. A flow of working fluid along the first portion of the working fluid flow path can be substantially counter to a flow of exhaust along the exhaust flow path, and the flow of working fluid along the second portion of the working fluid flow path can be substantially parallel to the flow of exhaust along the exhaust flow path.

18 Claims, 6 Drawing Sheets

U.S. PATENT DOCUMENTS

| | | | | |
|---|---|---|---|---|
| 5,899,003 | A * | 5/1999 | Strommen et al. | 34/363 |
| 6,019,070 | A * | 2/2000 | Duffy | 122/209.1 |
| 6,124,050 | A | 9/2000 | Stock | |
| 6,125,623 | A * | 10/2000 | Cloyd et al. | 60/783 |
| 6,514,634 | B1 | 2/2003 | Rush, Jr. | |
| 6,607,854 | B1 | 8/2003 | Rehg et al. | |
| 6,696,192 | B2 | 2/2004 | Kanai et al. | |
| 6,698,608 | B2 | 3/2004 | Parker et al. | |
| 6,713,204 | B2 | 3/2004 | Shimanuki et al. | |
| 6,895,740 | B2 * | 5/2005 | Erickson | 60/39.182 |
| 6,904,754 | B2 | 6/2005 | Sim et al. | |
| 6,905,792 | B2 | 6/2005 | Imaseki et al. | |
| 6,924,051 | B2 | 8/2005 | Meissner et al. | |
| 7,037,610 | B2 | 5/2006 | Meissner et al. | |
| 7,112,379 | B2 | 9/2006 | Skiba | |
| 7,168,233 | B1 * | 1/2007 | Smith et al. | 60/39.182 |
| 7,172,827 | B2 | 2/2007 | Scholta | |
| 7,357,100 | B2 * | 4/2008 | Waseda et al. | 122/511 |
| 7,849,692 | B2 | 12/2010 | Baldwin | |
| 2003/0217705 | A1 | 11/2003 | Lung et al. | |
| 2004/0013918 | A1 | 1/2004 | Merida-Donis | |
| 2004/0031256 | A1 | 2/2004 | Rollins, III | |
| 2004/0053095 | A1 | 3/2004 | Meissner et al. | |
| 2006/0112693 | A1 * | 6/2006 | Sundel | 60/670 |

FOREIGN PATENT DOCUMENTS

| | | |
|---|---|---|
| EP | 0154975 | 9/1985 |
| EP | 1162680 | 12/2001 |
| EP | 1235291 | 8/2002 |
| EP | 1536185 | 6/2005 |
| GB | 681811 | 10/1952 |
| JP | 1241760 | 9/1989 |
| WO | 03/063276 | 7/2003 |
| WO | 2004/016992 | 2/2004 |
| WO | 2005/101562 | 10/2005 |

* cited by examiner

HEAT RECOVERY SYSTEM AND METHOD

CROSS REFERENCE TO RELATED APPLICATIONS

The present application claims the benefit of U.S. Provisional Patent Application Ser. No. 60/859,192, filed Nov. 15, 2006 and U.S. Provisional Patent Application Ser. No. 60/860,272, filed Nov. 21, 2006, the contents of both of which are incorporated herein by reference.

FIELD OF THE INVENTION

The present invention relates to heat recovery systems and, more particularly, to an exhaust gas waste heat recovery system and a method of operating the same.

SUMMARY

In some embodiments, the present invention provides a heat recovery system for use in a vehicle to convert waste heat energy generated during engine operation into electric power. The heat recovery system can include two or three heat exchangers enclosed in a housing and arranged along a flow path.

In some embodiments, exhaust from the vehicle engine and a working fluid travel through a first heat exchanger along substantially counter-directional flow paths. Exhaust from the vehicle engine and the working fluid can travel along substantially parallel flow paths through a second heat exchanger and/or a third heat exchanger.

The heat recovery system can also include a valve arrangement for controlling the flow of a working fluid along the flow path. In some embodiments, the valve arrangement can be operable to alter the flow path of the working fluid based upon a characteristic (e.g., a temperature, pressure, volume, etc.) of exhaust entering the heat recovery system.

In some embodiments, the present invention provides a heat recovery system for use with a vehicle. The heat recovery system can include a volume of a working fluid, a housing enclosing a first heat exchanger, a second heat exchanger, and a third heat exchanger, and a flow path extending between the first, second, and third heat exchangers. In some embodiments, the flow path can be a first flow path, and the heat recovery system can include a second flow path, a first portion of which can be substantially parallel to the first flow path and a second portion of which can be substantially non-parallel or counter to the first flow path.

In some embodiments, the present invention provides a heat recovery system including a volume of working fluid and a first heat exchanger, a second heat exchanger, and a third heat exchanger connected in a single integral unit. The heat recovery system can also include a flow path extending between the first, second, and third heat exchangers.

The present invention also provides a method of operating a heat recovery system including the acts of directing a working fluid and vehicle engine exhaust through a first heat exchanger along substantially counter-directional flow paths and directing the working fluid and the exhaust through a second heat exchanger and a third heat exchanger along a substantially parallel flow path. The method can also include the act of adjusting the flow of the working fluid in response to a change in a characteristic (e.g., the temperature, pressure, flow rate, etc.) of exhaust traveling through the heat recovery system.

In some embodiments, the present invention provides a heat recovery system for use with a vehicle. The heat recovery system can house a working fluid and can include a first heat exchanger, a turbine, and a housing enclosing a second heat exchanger and a condenser. The housing can also enclose a third heat exchanger and a vent arrangement for venting vapor from the working fluid. In some embodiments, the first working fluid travels through the housing along a first flow path and a second working fluid travels through the housing along a second flow path, a portion of which is substantially counter to the first flow path.

In addition, the present invention provides a heat recovery system including a flow path extending through a first heat exchanger, a turbine, a pump, and a housing enclosing a second heat exchanger and a third heat exchanger. In some embodiments, a working fluid traveling along the flow path exits the housing after traveling through the second heat exchanger, travels through a pump, and reenters the housing before returning to the second heat exchanger.

In some embodiments, the present invention provides a heat recovery system including a flow path, which houses a working fluid and extends through a first heat exchanger, a turbine, a pump, and a housing enclosing a second heat exchanger and a vent arrangement. The vent arrangement can be operable to vent vapor from the working fluid before the working fluid enters the pump.

The present invention also provides a method of operating a heat recovery system including the acts of directing a working fluid and vehicle engine exhaust through a first heat exchanger, directing the working fluid from the first heat exchanger through a turbine to generate electric power, and directing the working fluid from the turbine into a housing enclosing a second heat exchanger and a condenser. The method can also include the acts of directing the working fluid through a third heat exchanger and a vent arrangement enclosed in the housing and venting vapor from the working fluid.

In some embodiments, the present invention provides an exhaust gas waste heat recovery heat exchanger including a housing having a working fluid inlet, a working fluid outlet for dispensing a superheated vapor, an exhaust inlet, and an exhaust outlet, an exhaust flow path extending through the housing between the exhaust inlet and the exhaust outlet, and a working fluid flow path extending through the housing between the working fluid inlet and the working fluid outlet. The working fluid flow path can include a first portion adjacent to the working fluid inlet and a second portion spaced apart from the working fluid inlet. A flow of working fluid along the first portion of the working fluid flow path can be substantially counter to a flow of exhaust along the exhaust flow path adjacent to the first portion of the working fluid flow path to receive heat from the flow of exhaust traveling along the exhaust flow path. The flow of working fluid along the second portion of the working fluid flow path can be substantially parallel to the flow of exhaust along the exhaust flow path adjacent to the second portion of the working fluid flow path.

The present invention also provides an exhaust gas waste heat recovery heat exchanger including a vaporizer operable to vaporize a flow of working fluid, a superheater operable to superheat the flow of working fluid received from the vaporizer, a preheater operable to transfer heat from a flow of exhaust, after the exhaust flow exits the superheater, to the flow of working fluid, before the flow of working fluid enters the vaporizer, and a housing enclosing the vaporizer, the superheater, and the preheater. The housing can include a working fluid inlet communicating with the preheater to supply the flow of working fluid to the preheater, a working fluid outlet for exhausting superheated working fluid vapor from the superheater, an exhaust inlet for supplying exhaust to the vaporizer, and an exhaust outlet for venting the exhaust.

In some embodiments, the present invention provides a heat recovery system including a turbine and an exhaust gas waste heat recovery heat exchanger. The exhaust waste heat recovery heat exchanger can include a housing having a working fluid inlet, a working fluid outlet, an exhaust inlet, and an exhaust outlet, an exhaust flow path extending through the housing between the exhaust inlet and the exhaust outlet, and a working fluid flow path extending through the housing between the working fluid inlet and the working fluid outlet. The working fluid flow path can include a first portion adjacent to the working fluid inlet and a second portion spaced apart from the working fluid inlet. A flow of working fluid along the first portion of the working fluid flow path can be substantially counter to a flow of exhaust along the exhaust flow path adjacent to the first portion of the working flow path to receive heat from the flow of exhaust traveling along the exhaust flow path. The flow of working fluid along the second portion of the working fluid flow path can be substantially parallel to the flow of exhaust along the exhaust flow path adjacent to the second portion of the working fluid flow path. The heat recovery system can also include a heat transfer circuit extending between a turbine outlet and the working fluid flow path.

In addition, the present invention provides a method of recovering waste heat from exhaust. The method can include the acts of directing a flow of exhaust along an exhaust flow path through a housing of an exhaust gas waste heat recovery heat exchanger between an exhaust inlet defined in the housing and an exhaust outlet defined in the housing, directing a flow of a working fluid along a working fluid flow path through the housing between a working fluid inlet defined in the housing and a working fluid outlet defined in the housing, and transferring heat from the exhaust traveling along the exhaust flow path to the working fluid traveling along a first portion of the working fluid flow path in a direction substantially counter to the flow of exhaust along the adjacent exhaust flow path to preheat the working fluid. The method can also include the acts of directing the preheated working fluid from the first portion of the working fluid flow path to a second portion of the working fluid flow path, and transferring heat from the exhaust traveling along the exhaust flow path to the preheated working fluid traveling along the second portion of the flow path in a direction substantially parallel to the flow of exhaust along the adjacent exhaust flow path to superheat the flow of working fluid exiting the housing through the working fluid outlet.

In some embodiments, the present invention provides an integrated heat exchanger including a recuperator having a first pass and a second pass adjacent to the first pass for transferring heat from a working fluid traveling along the first pass to the working fluid traveling along the second pass and a condenser positioned adjacent to the recuperator to receive the working fluid from the first pass of the recuperator and having a first coolant flow pass for receiving heat from the working fluid flowing through the condenser to condense the working fluid flowing through the condenser. The integrated heat exchanger can also include a subcooler positioned adjacent to the condenser to receive the condensed working fluid from the condenser and having a second coolant flow pass, and a housing enclosing the recuperator, the subcooler, and the condenser and including a working fluid inlet, a working fluid outlet, a coolant inlet, and a coolant outlet, the first coolant flow pass extending through the housing and communicating between the coolant inlet and the coolant outlet.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," and "having" and variations thereof herein is meant to encompass the items listed thereafter and equivalents thereof as well as additional items.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Also, it is to be understood that phraseology and terminology used herein with reference to device or element orientation (such as, for example, terms like "central," "upper," "lower," "front," "rear," and the like) are only used to simplify description of the present invention, and do not alone indicate or imply that the device or element referred to must have a particular orientation. In addition, terms such as "first", "second," and "third" are used herein for purposes of description and are not intended to indicate or imply relative importance or significance.

Figure 1:
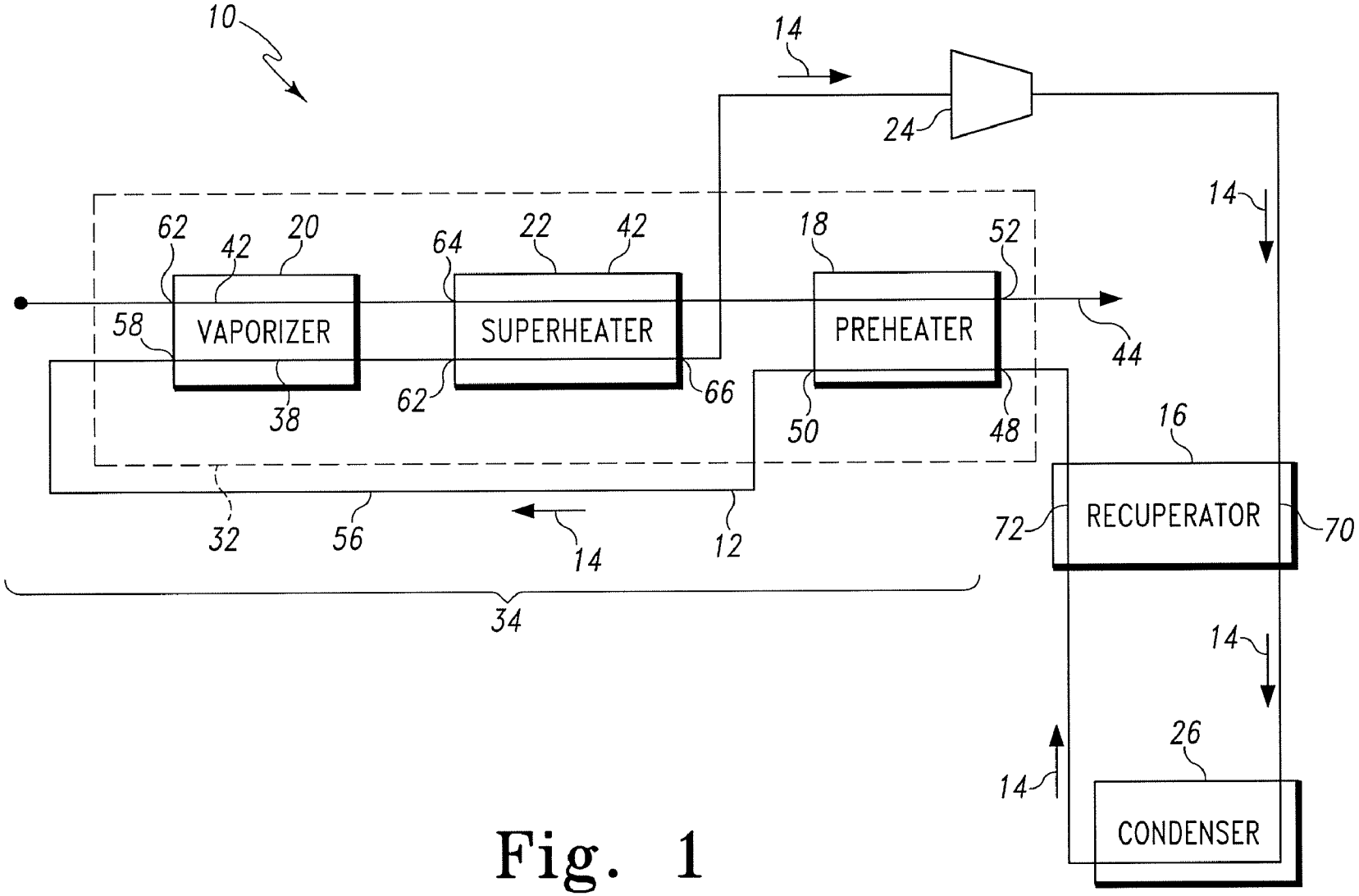
FIG. 1 is a schematic illustration of a heat recovery system according to some embodiments of the present invention.
Figure 2:
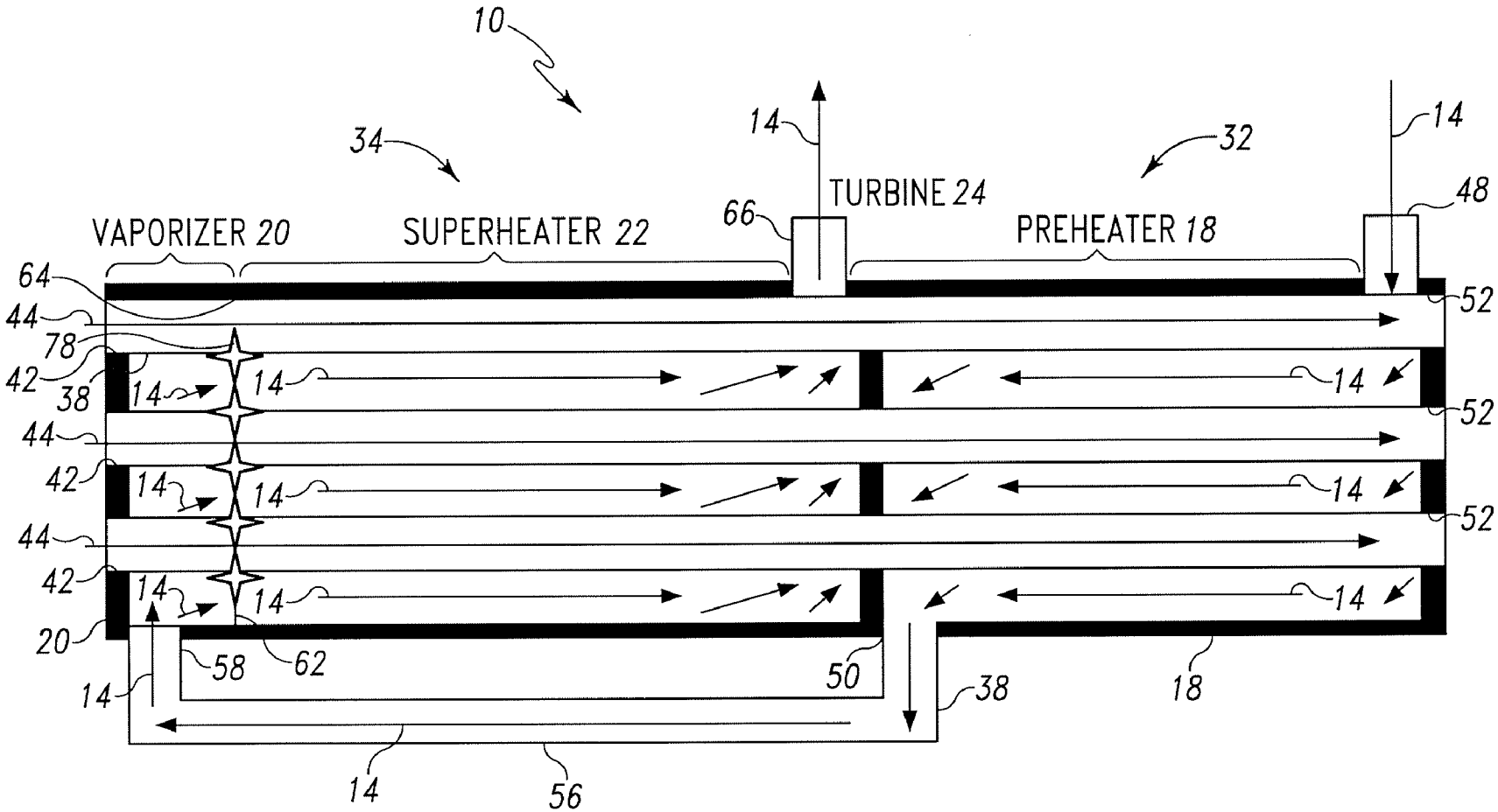
FIG. 2 is a cross-sectional view of a portion of the heat recovery system shown in FIG. 1.

FIGS. 1 and 2 illustrate a heat recovery system 10 for use with a vehicle having an internal combustion engine (e.g., a diesel engine). In other embodiments, the heat recovery system 10 can be used in other (e.g., non-vehicular) applications, such as, for example, in electronics cooling, industrial equipment, building heating and air-conditioning, and the like.

In some embodiments, approximately 40% of energy generated by fuel combustion in the vehicle engine is directed through the vehicle exhaust system. As explained in greater detail below, the heat recovery system 10 or a portion of the heat recovery system 10 of the present invention can be positioned along the vehicle exhaust system and can operate as a Rankine cycle or a portion of a Rankine cycle to convert waste heat energy generated during engine operation into electric power, thereby improving the overall energy efficiency of the vehicle.

The heat recovery system 10 can include a heat transfer circuit 12 having a volume of a first or working fluid (e.g., R245fa, water, $CO_2$, an organic refrigerant, and the like) (represented by arrows 14 in FIGS. 1 and 2). In the illustrated embodiment of FIGS. 1-3, the heat transfer circuit 12 extends between and fluidly connects a recuperator 16, a first heat exchanger or preheater 18, a second heat exchanger or vaporizer 20, a third heat exchanger or superheater 22, a turbine 24, and a condenser 26. In some embodiments, the heat transfer circuit 12 can also include one or more pumps positioned along the heat transfer circuit 12 for maintaining fluid pressure in the heat transfer circuit 12 or a portion of the heat transfer circuit 12.

Figure 3:
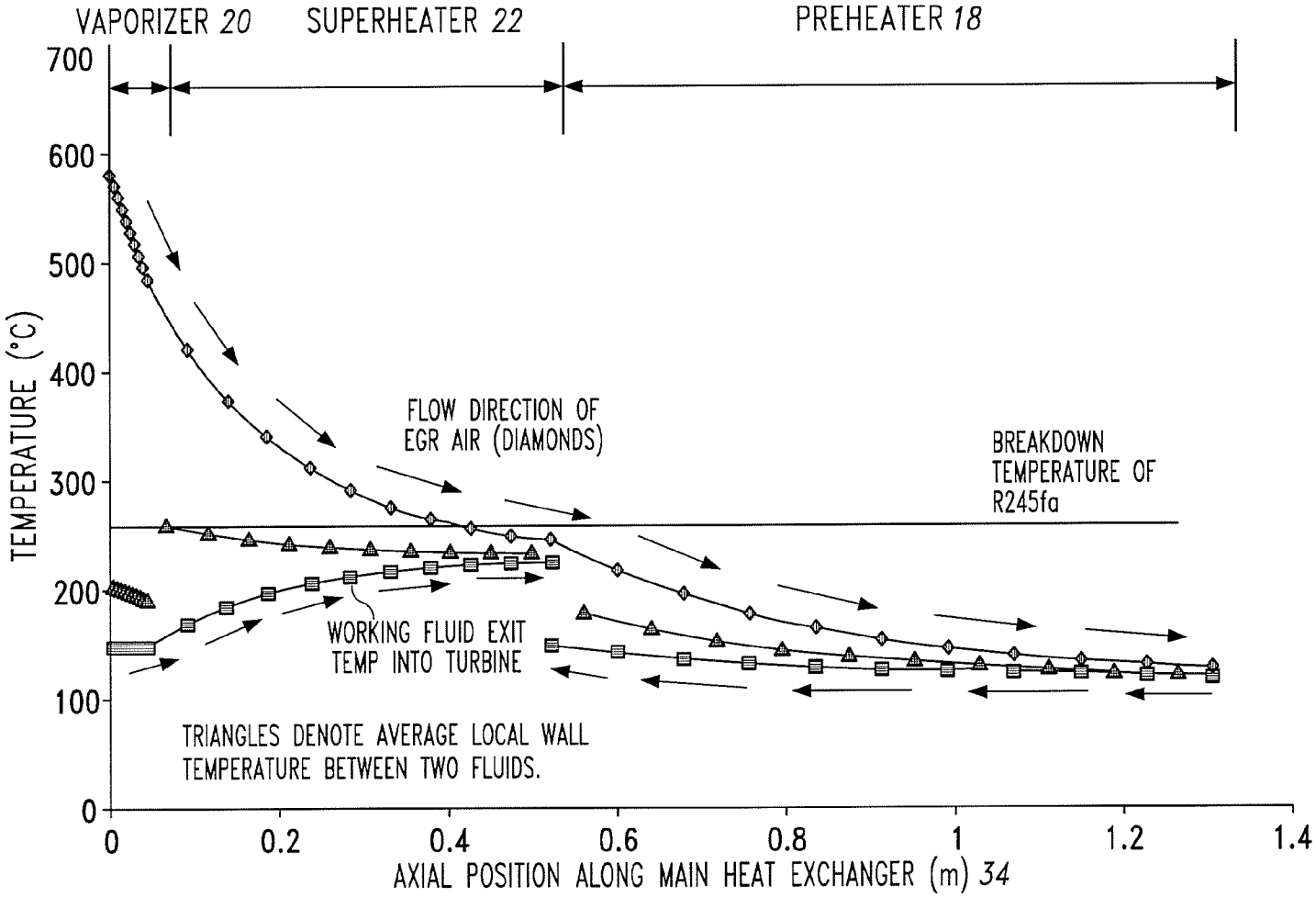
FIG. 3 is a graph showing performance values of the heat recovery system along a length of a portion of the heat recovery system shown in FIG. 1.
Figure 4:
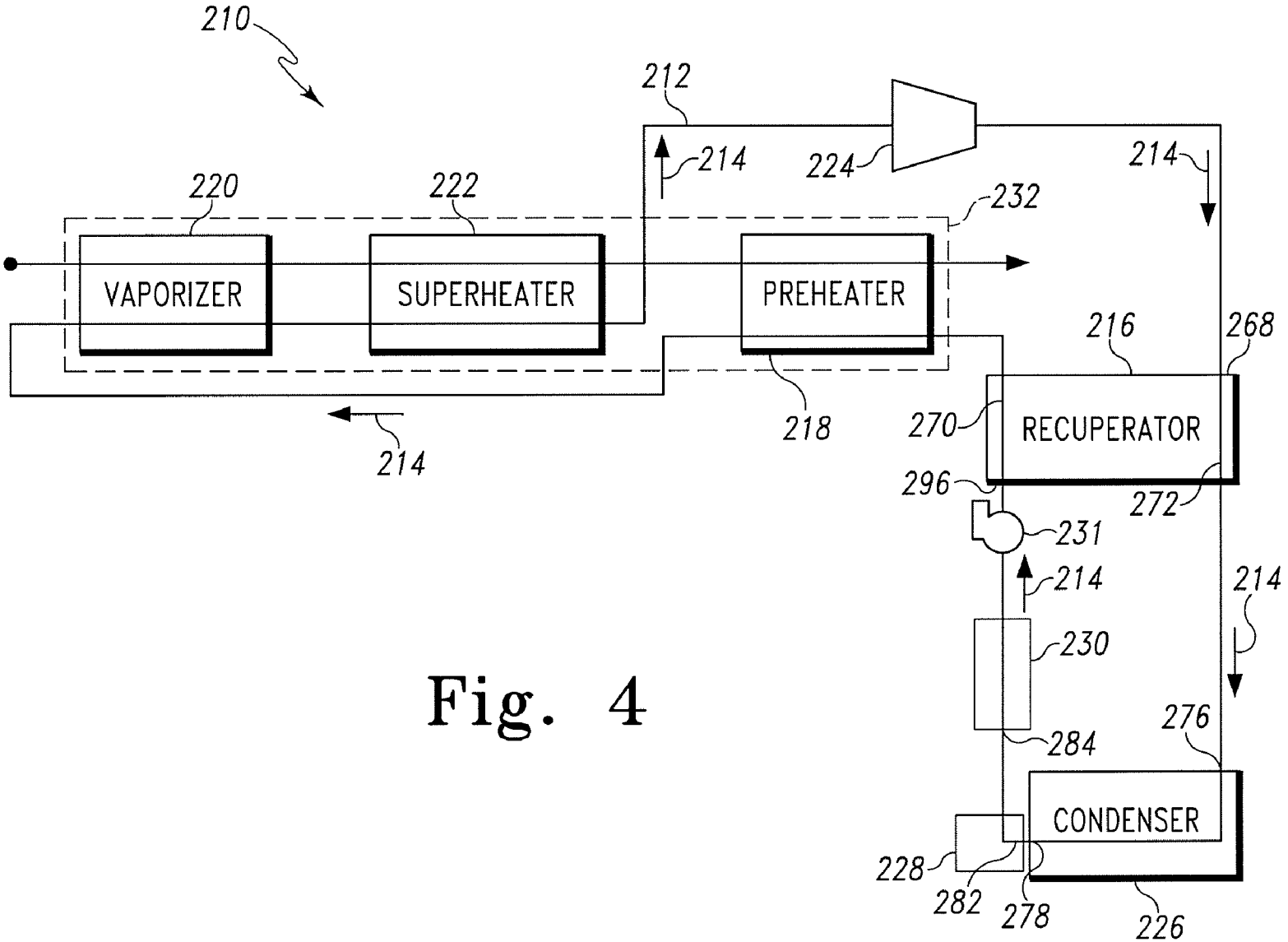
FIG. 4 is a schematic illustration of a heat recovery system according to another embodiment of the present invention.
Figure 5:
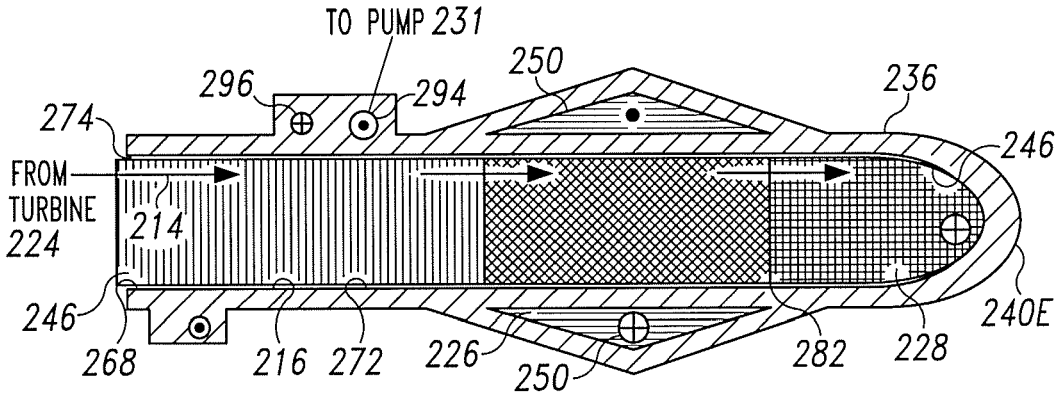
FIG. 5 is a cross-sectional view of a portion of the heat recovery system shown in FIG. 4, including a housing enclosing portions of a recuperator, a condenser, and a receiver.

In some embodiments, such as the illustrated embodiment of FIGS. 1-3, the preheater 18, the vaporizer 20, and the superheater 22 can be enclosed or at least partially enclosed in a single integral housing 32. In other embodiments, two of the preheater 18, the vaporizer 20, and the superheater 22 can be enclosed or at least partially enclosed in the housing 32. In still other embodiments, each of the preheater 18, the vaporizer 20, and the superheater 22 can be separately housed. In such embodiments, the preheater 18, the vaporizer 20, and the superheater 22 can be grouped together in a single location on the vehicle, or alternatively, the preheater 18, the vaporizer 20, and the superheater 22 can be distributed in different locations around the vehicle, such as, for example, under the vehicle frame, in the vehicle engine compartment, in the vehicle cargo space, and in the vehicle passenger space.

Alternatively or in addition, the preheater 18, the vaporizer 20, and the superheater 22 can be connected in a single integral unit and/or assembled as a unit prior to installation in a vehicle or building. In other embodiments, two of the preheater 18, the vaporizer 20, and the superheater 22 can be connected in a single integral unit and/or assembled as a unit prior to instillation in a vehicle or building.

As shown in FIG. 2, in embodiments in which the preheater 18, the vaporizer 20, and the superheater 22 are enclosed in the housing 32, the preheater 18, the vaporizer 20, and the superheater 22 can be integrally formed so that each of the preheater 18, the vaporizer 20, and the superheater 22 defines a section of an integral main heat exchanger 34. In some such embodiments, the working fluid 14 can be vaporized and superheated while traveling through the main heat exchanger 34.

In some embodiments, the main heat exchanger 34 can have a bar and plate configuration defining a first flow path 38 for the working fluid 14 and a second flow path 42 for exhaust (represented by arrows 44 in FIGS. 1 and 2) from the vehicle engine. In the illustrated embodiment of FIGS. 1-3, the main heat exchanger 34 is a stainless steel heat exchanger having three working fluid flow passes and three exhaust flow passes, a 6.5 mm square wave fin on an air side, and a 3.0 mm lanced offset fin on a working fluid side.

In some embodiments, including embodiments in which the preheater 18, the vaporizer 20, and the superheater 22 are enclosed in the housing 32, embodiments in which the vaporizer 20, and the superheater 22 can be connected in a single integral unit or assembled as a unit prior to instillation, and embodiments in which the preheater 18, vaporizer 20, and superheater 22 are distributed around the vehicle, one or more of the preheater 18, vaporizer 20, and superheater 22 can have a different configuration (e.g., shape, size, and orientation, fin and tube, tube-in-tube, and the like) and can be manufactured from other materials (e.g., aluminum, iron, and other metals, composite material, and the like) having other heat transfer coefficients.

In the illustrated embodiment of FIGS. 1-3, a first portion of the main heat exchanger 34 is configured as a counter-flow heat exchanger and a second portion of the main heat exchanger 34 is configured as a parallel-flow heat exchanger. More specifically, in the illustrated embodiment, the preheater 18 is configured as a counter-flow heat exchanger and the vaporizer 20 and the superheater 22 are configured as parallel-flow heat exchangers.

In other embodiments, all or substantially all of the main heat exchanger 34 can be configured as a parallel-flow heat exchanger. Such a heat exchanger includes at least two flow paths in which the first working fluid 14 and the exhaust 44 flow in the same direction. Alternatively all or substantially all of the main heat exchanger 34 can be configured as a counter-flow heat exchanger. In still other embodiments, the preheater 18 can have a parallel-flow configuration and the vaporizer 20 and the superheater 22 can have a counter-flow configuration. In yet other embodiments, each of the preheater 18, the vaporizer 20, and the superheater 22 can have a different flow configuration.

In the illustrated embodiment of FIGS. 1-3, the working fluid 14 enters the preheater 18 through an inlet 48 in the preheater 18 at between about 110° C. and about 130° C. and exhaust 44 enters the preheater at between about 240° C. and about 260° C. In other embodiments, the working fluid 14 can have other temperatures, depending upon the flow characteristics (e.g., flow rate, temperature, pressure, etc.) of the exhaust 44, the particular working fluid 14 selected and the characteristics (e.g., boiling-point temperature, chemical-breakdown temperature, etc.) of the working fluid 14, the mass flow rate of the working fluid 14 through the heat transfer circuit 12, and the like.

From the inlet 48, the working fluid 14 travels through the first flow path 38 through the preheater 18 toward an outlet 50 of the preheater 18. Exhaust 44 travels through the second flow path 42 of the preheater 18 toward an exhaust outlet 52. As the working fluid 14 and the exhaust 44 travel through the preheater 18 along respective first and second flow paths 38, 42, the preheater 18 transfers heat energy from the exhaust 44 to the working fluid 14.

From the outlet 50 of the preheater 18, the working fluid 14 travels along the first flow path 38 and through a bypass 56 to an inlet 58 of the vaporizer 20. In the illustrated embodiment of FIGS. 1-3, the working fluid 14 enters the vaporizer 20 through the inlet 58 at between about 140° C. and about 160° C. and the exhaust 44 enters the second flow path 42 through an inlet 62 in the vaporizer 20 at between about 570° C. and about 590° C.

In some embodiments, the temperature of the working fluid 14 at the inlet 62 is about 150° C. In other embodiments, the working fluid 14 can have other temperatures, depending upon the flow characteristics (e.g., flow rate, temperature, pressure, etc.) of the exhaust 44, the particular working fluid 14 selected and the characteristics (e.g., boiling point temperature, chemical breakdown temperature, etc.) of the working fluid 14, the mass flow rate of the working fluid 14 through the heat transfer circuit 12, and the like.

Because the working fluid 14 has been heated prior to entering the vaporizer 20, the temperature gradient at the inlet 58 of the vaporizer 20 is reduced significantly (e.g., in some embodiments, by as much as about 10% or between about 30° C. and about 40° C.). In some embodiments, the temperature gradient at the inlet 58 between the first working fluid 14 and the exhaust 44 can be reduced by as much as 32° C. In this manner, the thermal stresses experienced by the main heat exchanger 34, and particularly the vaporizer 20 and superheater 22, can be minimized and the fatigue life of the heat recovery system 10 can be improved.

With continued reference to the illustrated embodiment of FIGS. 1-3, the working fluid 14 and the exhaust 44 then travel along substantially parallel portions of respective first and second flow paths 38, 42 toward the superheater 22. The working fluid 14 can enter an inlet 62 of the superheater 22 at between about 160° C. and about 180° C. and the exhaust 44 can enter an inlet 64 of the superheater 22 at between about 490° C. and about 460° C. In other embodiments, the working fluid 14 can have other temperatures, depending upon the flow characteristics (e.g., flow rate, temperature, pressure, etc.) of the exhaust 44, the particular working fluid 14 selected and the characteristics (e.g., boiling point temperature, chemical breakdown temperature, etc.) of the working fluid 14, the mass flow rate of the working fluid 14 through the heat transfer circuit 12, and the like. Similarly, in other embodiments, the exhaust 44 can have other temperatures, depending upon the flow characteristics (e.g., flow rate, temperature, pressure, etc.) of the working fluid 14, the particular working fluid 14 selected and the characteristics (e.g., boiling point temperature, chemical breakdown temperature, etc.) of the working fluid 14, the mass flow rate of the working fluid 14 through the heat transfer circuit 12, and the like.

As the working fluid 14 and the exhaust 44 travel through the superheater 22, the superheater 22 transfers heat energy from the exhaust 44 to the working fluid 14, thereby raising the temperature of the working fluid 14 exiting the superheater 22 through an outlet 66 in the superheater 22. In some embodiments, the temperature of the working fluid 14 is raised in this manner to between about 220° C. and about 230° C. In some embodiments, the temperature of the working fluid 14 at the outlet 66 is about 227° C. In other embodiments, the working fluid 14 can have other temperatures, depending upon the flow characteristics (e.g., flow rate, temperature, pressure, etc.) of the exhaust 44, the particular working fluid 14 selected and the characteristics (e.g., boiling point temperature, chemical breakdown temperature, etc.) of the working fluid 14, the mass flow rate of the working fluid 14 through the heat transfer circuit 12, and the like.

In some embodiments, such as the illustrated embodiment of FIGS. 1-3 in which the superheater 22 has a parallel flow configuration, the superheater 22 can pinch the temperature of the working fluid 14 so that the temperature of the working fluid 14 exiting the superheater 22 is maintained within a relatively small temperature range (e.g., between about 220° C. and about 230° C.) despite potential fluctuations in exhaust temperature, exhaust flow rates, and ambient temperatures, thereby improving the efficiency of the turbine 24 and preventing the working fluid 14 from reaching a chemical breakdown temperature (e.g., about 260° C. for R245fa).

In some embodiments, one or both of the exhaust temperature, exhaust pressure, and exhaust flow rate can vary significantly based upon vehicle engine conditions, including the amount of fuel supplied to the engine over a given time. In some such embodiments, the superheater 22 can be oversized (e.g., by at least as much as about 25% above normal operating requirements) so that when gas flow is interrupted (e.g., when the fuel supply to the vehicle engine is interrupted), all or substantially all of the working fluid 14 traveling along the first flow path 38 through the vaporizer 20 and the superheater 22 is vaporized before entering the turbine 24.

From the superheater 22, the exhaust 44 travels through the vehicle exhaust system and is vented to the atmosphere at a reduced temperature, and the working fluid 14 is directed through the turbine 24 to generate electrical power. While traveling through the turbine 24, the temperature and pressure of the working fluid 14 are reduced, and, in some embodiments, at least some of the working fluid 14 condenses into a liquid state. The working fluid 14 is then directed through a first flow path 70 of the recuperator 16 toward the condenser 26, where the working fluid 14 is condensed into a liquid state before being directed through a second flow path 72 of the recuperator 16.

In some embodiments, at least some of the working fluid 14 can travel directly from the turbine 24 to the condenser 26, bypassing the first flow path 70 of the recuperator 16 and at least some of the working fluid 14 can bypass the second flow path 72 of the recuperator 16. In still other embodiments, the heat recovery system 10 can operate without a recuperator 16.

In embodiments of the heat recovery system 10 having a recuperator 16, such as the illustrated embodiment of FIGS. 1-3, working fluid 14 traveling through the first flow path 70 and having an elevated temperature (e.g., between about 160° C. and about 180° C.) transfers heat energy to working fluid 14 traveling through the second flow path 72 having a lower temperature (e.g., between about 50° C. and about 60° C.). After the working fluid 14 is heated in the recuperator 16, the working fluid 14 is returned to the preheater 18 and recycled through the heat transfer circuit 12 as described above.

In some embodiments, the working fluid 14 can have a pressure of between about 3400 kPa and about 3550 kPa between the preheater 18 and the turbine 24, and the exhaust 44 can have a pressure of between about 245 kPa and about 285 kPa. In other embodiments, the working fluid 14 can have other temperatures and pressures than those mentioned above with respect to the illustrated embodiment of FIGS. 1-3, depending upon at least one of the exhaust temperature and pressure, the particular working fluid 14, and the configuration (e.g., shape, size, and orientation) of the preheater 18, the vaporizer 20, and the superheater 22. Similarly, the exhaust 44 can have other temperatures and pressures than those mentioned above with respect to the illustrated embodiment of FIGS. 1-3, depending upon at least one of the chemical breakdown temperature of the working fluid 14, the mass flow rate of fuel to the vehicle engine, the type and construction of the vehicle engine, and the configuration (e.g., shape, size, and orientation) of the preheater 18, the vaporizer 20, and the superheater 22.

The configuration (e.g., size, shape, orientation, etc.) of each element of the heat recovery system 10 (e.g., the preheater 18, the vaporizer 20, and the superheater 22) and the flow paths (e.g., parallel-flow, counter-flow, etc.) extending through each element of the heat recovery system 10 can be designed to ensure that the temperature of the working fluid 14 does not rise above the chemical breakdown temperature of the working fluid 14 and to ensure that hot spots 78 along the first flow path 38 do not reach temperatures above the chemical breakdown temperature of the working fluid 14. Similarly, the number, shape, size, and orientation of fins and the heat transfer coefficients of each of the elements of the heat recovery system 10 can be selected to ensure that the temperature of the working fluid 14 does not reach the chemical breakdown temperature of the working fluid 14 during operation of the heat recovery system 10.

In the illustrated embodiment of FIGS. 1-3, the heat recovery system 10 includes a single preheater 18 positioned along the heat transfer circuit 12. However, in some embodiments, the heat recovery system 10 can include a second preheater 18 positioned upstream from the vaporizer 20 along the heat transfer circuit 12. In these embodiments, the second preheater 18 transfers heat energy from the exhaust 44 to the working fluid 14 so that exhaust 44 enters the vaporizer 20 at a reduced temperature, thereby lowering the wall temperature of the vaporizer 20, and helping to ensure that the temperature of the working fluid 14 traveling through the vaporizer 20 does not reach the chemical breakdown temperature of the working fluid 14.

In some such embodiments, the working fluid 14 exits the second preheater 18 in a liquid state with little or no vapor, thereby improving fluid flow through the heat transfer circuit 12 to the vaporizer 20. In other embodiments, at least some of the working fluid 14 exits the preheater 18 in a vapor state.

In some embodiments, the heat recovery system 10 can include a controller. In some such embodiments, the heat recovery system 10 can also include a sensor positioned adjacent to or upstream from the inlet 58 to the vaporizer 20 for measuring a temperature or pressure of the working fluid 14, at least one alternate flow path positioned along the heat transfer circuit 12, and a valve arrangement for controlling flow of the working fluid 14 along the first flow path 38 and along the alternate flow path. In some embodiments, the valve arrangement can include one or more solenoid-controlled valves.

In these embodiments, the controller can control the valve arrangement to redirect the working fluid 14 through the alternate flow path, bypassing the preheater 18 when the sensor measures a temperature outside of a desired temperature range. In this manner, the controller can direct relatively low temperature working fluid 14 to the inlet 58 of the vaporizer 20 so that the working fluid 14 entering the vaporizer 20 is not heated to a temperature above the chemical breakdown temperature of the working fluid 14.

In other embodiments, the heat recovery system 10 can have other valve arrangements and other alternate flow paths positioned around the heat transfer circuit to selectively bypass one or more elements of the heat recovery system 10 or portions of one or more elements of the heat recovery system 10 in response to changes in the characteristics (e.g., the temperature, pressure, flow rate, etc.) of the exhaust 44 traveling through the heat recovery system 10.

FIGS. 4-9 illustrate an alternate embodiment of a heat recovery system 210 according to the present invention. The heat recovery system 210 shown in FIGS. 4-9 is similar in many ways to the illustrated embodiments of FIGS. 1-3 described above. Accordingly, with the exception of mutually inconsistent features and elements between the embodiment of FIGS. 4-9 and the embodiments of FIGS. 1-3, reference is hereby made to the description above accompanying the embodiments of FIGS. 1-3 for a more complete description of the features and elements (and the alternatives to the features and elements) of the embodiment of FIGS. 4-9. Features and elements in the embodiment of FIGS. 4-9 corresponding to features and elements in the embodiments of FIGS. 1-3 are numbered in the 200 series.

As shown in FIGS. 4-9, the heat recovery system 210 can include a heat transfer circuit 212 having a volume of a first working fluid (e.g., R245fa, water, $CO_2$, an organic refrigerant, and the like) (represented by arrows 214 in FIGS. 4, 5, 6, and 9). In the illustrated embodiment of FIGS. 4-9, the heat transfer circuit 212 extends between and fluidly connects a first heat exchanger or recuperator 216, a preheater 218, a vaporizer 220, a superheater 222, a turbine 224, a second heat exchanger or condenser 226, a vapor chamber or receiver 228, a third heat exchanger or subcooler 230, and a pump 331.

In some embodiments, such as the illustrated embodiment of FIGS. 4-9, the recuperator 216, the condenser 226, the receiver 228, and the subcooler 230 can be enclosed or at least partially enclosed in a single integral housing 236. In other embodiments, two or three of the recuperator 216, the condenser 226, the receiver 228, and the subcooler 230 can be enclosed or at least partially enclosed in the housing 236. In still other embodiments, each of the recuperator 216, the condenser 226, the receiver 228, and the subcooler 230 can be separately housed. In such embodiments, the recuperator 216, the condenser 226, the receiver 228, and the subcooler 230 can be grouped together in a single location on a vehicle or in a building, or alternatively, the recuperator 216, the condenser 226, the receiver 228, and the subcooler 230 can be distributed in different locations around a vehicle (e.g., under the vehicle frame, in the vehicle engine compartment, in the vehicle cargo space, and in the vehicle passenger space) or a building.

Alternatively or in addition, the recuperator 216, the condenser 226, the receiver 228, and the subcooler 230 can be connected in a single integral unit and/or assembled as a unit prior to instillation in a vehicle or a building. In other embodiments, two or three of the recuperator 216, the condenser 226, the receiver 228, and the subcooler 230 can be connected in a single integral unit and/or assembled as a unit prior to instillation in a vehicle or a building.

Additionally, in some embodiments, the preheater 218, the vaporizer 220, and the superheater 222 can be enclosed or at least partially enclosed in another single integral housing 232, as described above with respect to the illustrated embodiment of FIGS. 1-3. In other embodiments, two of the preheater 218, the vaporizer 220, and the superheater 222 can be enclosed or at least partially enclosed in the housing 232. In still other embodiments, each of the preheater 218, the vaporizer 220, and the superheater 222 can be separately housed. In such embodiments, the preheater 218, the vaporizer 220, and the superheater 222 can be grouped together in a single location on a vehicle or in a building, or alternatively, the preheater 218, the vaporizer 220, and the superheater 222 can be distributed in different locations around a vehicle (e.g., under the vehicle frame, in the vehicle engine compartment, in the vehicle cargo space, and in the vehicle passenger space) or a building.

Alternatively or in addition, the preheater 218, the vaporizer 220, and the superheater 222 can be connected in a single integral unit and/or assembled as a unit prior to instillation in a vehicle or a building. In other embodiments, two of the preheater 218, the vaporizer 220, and the superheater 222 can be connected in a single integral unit and/or assembled as a unit prior to instillation in a vehicle or building.

Figure 6:
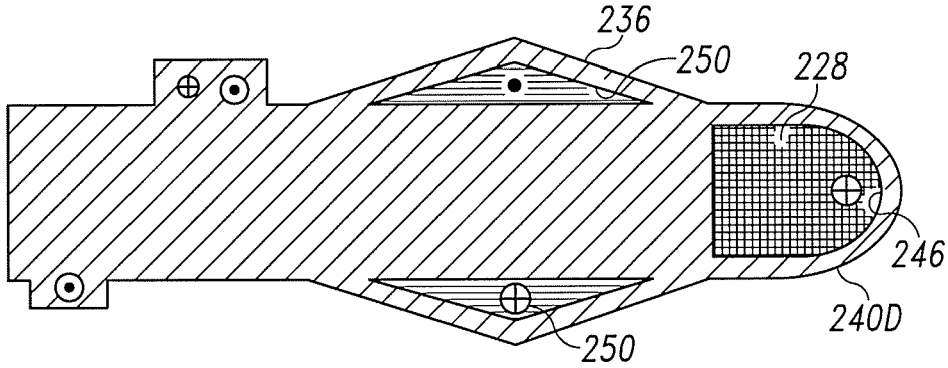
FIG. 6 is a cross-sectional view of another portion of the heat recovery system shown in FIG. 4, including the housing and portions of the recuperator, the condenser, and the receiver.
Figure 7:
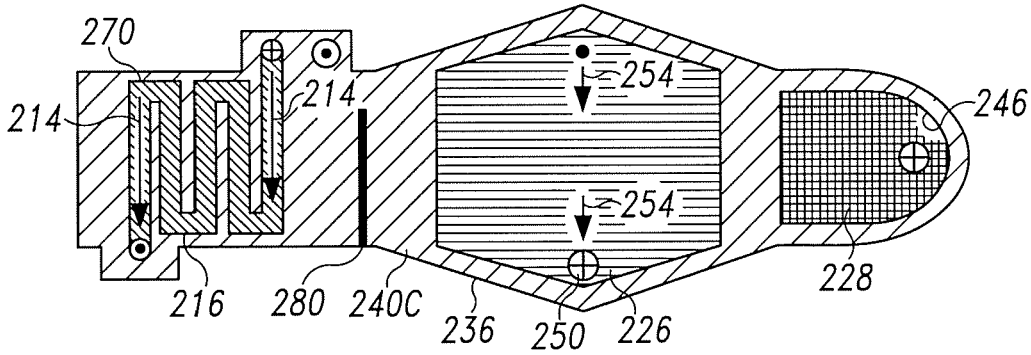
FIG. 7 is a cross-sectional view of still another portion of the heat recovery system shown in FIG. 4, including the housing and a portion of the receiver.
Figure 8:
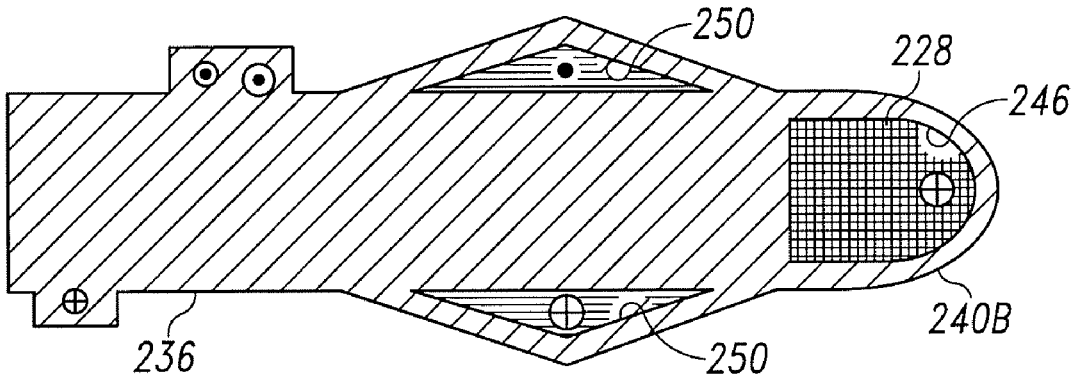
FIG. 8 is a cross-sectional view of yet another portion of the heat recovery system shown in FIG. 4, including the housing and a portion of the receiver.
Figure 9:
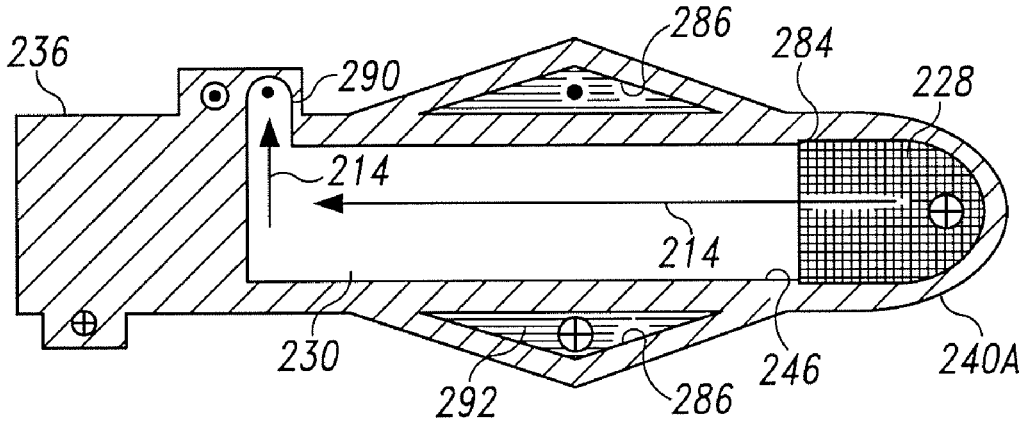
FIG. 9 is a cross-sectional view of another portion of the heat recovery system shown in FIG. 4, including the housing and portions of the subcooler and the receiver.

In embodiments, such as the illustrated embodiment of FIGS. 4-9, in which the recuperator 216, the condenser 226, the receiver 228, and the subcooler 230 are connected in a single integral unit and/or enclosed in a single integral housing 236, the housing 236 can be formed from a number of adjacent or layered plates 240 defining a first flow path 246 for the first working fluid 214 and a second flow path 250 for the second working fluid or coolant (represented by arrows 254 in FIG. 6).

In some embodiments, such as the illustrated embodiment of FIGS. 4-9, the housing 236 can be manufactured from aluminum sheets, which are stamped, cut, molded, rolled, or formed in a like manner to have a desired shape. In other embodiments, the housing 236 can be manufactured from other materials (e.g., steel, iron, and other metals, composite material, and the like) and can be formed using other conventional forming techniques.

In the illustrated embodiment of FIGS. 4-9, the housing 236 includes first, second, third, fourth, and fifth stacked plates 240A, 240B, 240C, 240D, 240E, which together at least partially enclose the recuperator 216, the condenser 226, the receiver 228, and the subcooler 230. In other embodiments, the housing 236 can include two, three, four, six, or more stacked plates 240, which together enclose or partially enclose at least one of the recuperator 216, the condenser 226, the receiver 228, and the subcooler 230.

In FIGS. 5-9, flow into the page is represented with a cross in a circle and flow out of the page is represented with a black dot. During operation of the heat recovery system 210, the first working fluid 214 exits the turbine 224 and can enter the recuperator 216 through a recuperator inlet 268 at between about 160° C. and about 180° C. The first working fluid 214 can then travel along the first flow path 246 through a first travel path 272 of the recuperator 216. In some embodiments, the first working fluid 214 enters the inlet 268 at about 170° C. In other embodiments, the first working fluid 214 can enter the inlet 268 at other temperatures depending upon the flow characteristics (e.g., flow rate, temperature, pressure, etc.) of the first working fluid 214, the particular first working fluid 214 selected and the characteristics (e.g., boiling point temperature, chemical breakdown temperature, etc.) of the first working fluid 214, the mass flow rate of the first working fluid 214 through the heat transfer circuit 212, and the like.

In some embodiments, the recuperator 216 includes a diffuser 274 having outwardly diverging walls. In these embodiments, the first working fluid 214 traveling along the first flow path 246 enters the inlet 268 of the recuperator 216 and travels through the diffuser 274 where outwardly diverging walls (not shown) of the diffuser 274 slow the flow rate of the first working fluid 214, transforming at least some of the dynamic pressure of the first working fluid 214 into static pressure.

In some embodiments, the recuperator 216 or the housing 236 can have protrusions or tabs extending outwardly from an outer wall. The tabs can be located adjacent to the inlet 268 of the recuperator 216, or alternatively, in another location on the housing 236 or the recuperator 216. In some embodiments, the tabs can be removed from the recuperator 216 or the housing 236 after the recuperator 216 and/or the housing 236 is/are secured to a vehicle or a building, or alternatively, after the recuperator 216 is secured (e.g., brazed, soldered, welded, or connected in another manner) to one or more of the condenser 226, the vaporizer 220, the subcooler 230, and/or the housing 236. Alternatively or in addition, the tabs can aid in the assembly of the recuperator 216 and/or the assembly of the housing 236.

In the illustrated embodiment of FIGS. 4-9, the first working fluid 214 travels out of the first travel path 272 of the recuperator 216 and into the condenser 226 through a condenser inlet 276, and the second working fluid 254 (e.g., water, a water/glycol mixture, air, $CO_2$, an organic refrigerant, and the like) travels along the second flow path 250 through the condenser 226. As the first working fluid 214 travels along the first flow path 246 from the inlet 276 toward an outlet 278, the condenser 226 transfers heat energy from the first working fluid 214 to the second working fluid 254. In some embodiments, the condenser 226 converts at least a portion of the first working fluid 214 from a vapor state to a liquid state. The condenser 226 can also include a port or recess 280, which can extend through at least a portion of the housing 232 and can be used to detect or monitor leaks.

In the illustrated embodiment of FIGS. 4-9, the condenser 226 is configured as a cross-flow heat exchanger such that the first flow path 246 or a portion of the first flow path 246 is opposite to or counter to the second flow path 250 or a portion of the second flow path 250. In other embodiments, the condenser 226 can have other configurations and arrangements, such as, for example, a parallel-flow or a counter-flow configuration.

In some embodiments, such as the illustrated embodiment of FIGS. 4-9, the second flow path 250 can be a closed circuit and the second working fluid 254 can be continuously recycled through the condenser 226. In other embodiments, the second flow path 250 can be open to the atmosphere.

From the outlet 278 of the condenser 226, the first working fluid 214 travels along the first flow path 246 through an inlet 282 in the receiver 228. As the first working fluid 214 travels through the receiver 228, vapor can be separated from the first working fluid 214 and exhausted through one or more vents in the receiver 228. In some embodiments, the vents can be timed or programmed (e.g., the vents can include solenoid-controlled valves) to open at predetermined intervals, or alternatively, the vents can be opened when one or more sensors determine that the temperature and/or pressure of the first working fluid 214 traveling through the receiver 228 is outside a predetermined temperature and/or pressure range. In embodiments in which the receiver 228 includes vents, the vents can prevent cavitation of the first working fluid 214 within the pump 231.

After traveling through the receiver 228, the first working fluid 214 continues to travel along the first flow path 246 through an inlet 284 in the subcooler 230 toward an outlet 290. In some embodiments, the subcooler 230 includes a flow path 286 for a second working fluid (e.g., water, a water/glycol mixture, air, $CO_2$, an organic refrigerant, and the like) 292 for cooling the first working fluid 214 as the first and second working fluids 214, 292 travel through the subcooler 230.

In some such embodiments, the second working fluid 292 of the subcooler 230 and the second working fluid 254 of the condenser 226 are the same. In these embodiments, the flow path 286 of the subcooler 230 can be connected to the condenser 226 such that the second working fluid 254 travels through both the subcooler 230 and the condenser 226. In other embodiments, the subcooler 230 and the condenser 226 can use different working fluids and the flow paths 286, 292 of the condenser 226 and the subcooler 230 can be separated.

In other embodiments, the heat recovery system 210 can include insulation positioned between two or more of the recuperator 216, the condenser 226, the receiver 228, and the subcooler 230 or between the plates 240 of the housing 236. In some such embodiments, the heat recovery system 210 can include a plate 240 having a hollow interior or a substantially hollow interior positioned between the first and the third plates 240A, 240C and between the subcooler 230 and the condenser 226 to prevent and/or reduce heat transfer between the first working fluid 214 in the subcooler 230 and the second working fluid 254 in the condenser 226, or alternatively, to prevent and/or reduce heat transfer between the first working fluid 214 in the subcooler 230 and the first working fluid 214 in the condenser 226. In some embodiments, the hollow interior of such a plate 240 can include fins and can house a volume of air. In other embodiments, the hollow interior of such a plate 240 can have other structural supports and can include other insulation materials, or alternatively, air can be evacuated from the hollow interior to prevent the transfer of heat from one side of the plate 240 to an opposite side of the plate 240.

As the first working fluid 214 travels through the subcooler 230, the subcooler 230 transfers heat energy from the first working fluid 214 to the second working fluid 292 to cool the first working fluid 214 to a temperature below the saturation temperature of the first working fluid 214 so that the first working fluid 214 has sufficient net positive suction head pressure prior to entering the pump 231. In some embodiments, the subcooler 230 also cools the first working fluid 214 to prevent cavitation of the first working fluid 214 as the first working fluid 214 travels through the pump 231.

In the illustrated embodiment of FIGS. 4-9, the subcooler 230 is configured as a single pass heat exchanger with the first and second working fluids 214, 292 traveling along cross-directional flow paths. In other embodiments, the subcooler 230 can be configured as a multiple pass heat exchanger and the first and second working fluids 214, 292 can travel along cross-directional flow paths, counter-directional flow paths, or substantially parallel flow paths.

From the outlet 290 of the subcooler 230, the first working fluid 214 travels along the first flow path 246 toward the pump 231. In the illustrated embodiment of FIGS. 4-9, the first flow path 246 extends upwardly from the first plate 240A, through the second, third, and fourth plates 240B, 240C, 240D, and out of the housing 236 through an opening 294 in the fifth plate 240E. In other embodiments, the first flow path 246 can have other orientations, can flow through the housing 236, and can exit the housing 236 through an opening 294 in any one of the first, second, third, or fourth plates 240A, 240B, 240C, 240D.

In embodiments, such as the illustrated embodiment of FIGS. 4-9, in which the heat recovery system 210 includes a pump 231, the pump 231 operates to maintain the pressure of the first working fluid 214 within a desired pressure range as the first working fluid 214 flows through the first flow path 246. As shown in FIGS. 4-9, the pump 231 can be located outside of and adjacent to the housing 236. Alternatively, the pump 231 can be secured to or integrally formed with the housing 236 so that the housing 236 and the pump 231 can be connected as a single integral unit and/or assembled as a unit prior to instillation in a vehicle or a building. In other embodiments, the pump 231 can be located inside the housing 231.

From the pump 231, the first working fluid 214 travels along the first flow path 246 toward an inlet 296 to the second travel path 270 of the recuperator 216. In the illustrated embodiment of FIGS. 4-9, the first flow path 246 extends through an opening in the fifth plate 240E and downwardly through the fourth and fifth plates 240D, 240E before entering the second travel path 270, which extends through the third plate 240C of the housing 236. In other embodiments, the second travel path 270 of the recuperator 216 can have other locations, such as, for example, in the first, second, fourth, or fifth plates 240A, 240B, 240E, and the flow path 246 can have other orientations and can enter the housing 236 through an opening 294 in any one of the first, second, third, or fourth plates 240A, 240B, 240C, 240D.

As the working fluid 214 travels through the recuperator 216, the recuperator 216 transfers heat energy from the first working fluid 214 traveling through the first travel path 272 of the recuperator 216 to the first working fluid 214 traveling through the second travel path 270 of the recuperator 216 to raise the temperature and/or the pressure of the first working fluid 214 entering the preheater 218. Alternatively or in addition, the recuperator 216 improves the efficiency of the heat recovery system 210 by conserving heat energy.

In the illustrated embodiment of FIGS. 4-9, the recuperator 216 is configured as a multiple pass heat exchanger with the first and second travel paths 272, 270 oriented to provide cross-directional flow. In other embodiments, the recuperator 216 can be configured as a single pass heat exchanger and the first and second travel paths 272, 270 can be oriented to provide parallel flow or counter-directional flow.

In the illustrated embodiment of FIGS. 4-9, the first working fluid 214 travels along the first flow path 246 from the second travel path 270 of the recuperator 216 through the preheater 218, the vaporizer 220, and the superheater 222 before being returned to the turbine 224. In other embodiments, the first working fluid 214 or at least a portion of the first working fluid 214 can bypass one or more of the preheater 218, the vaporizer 220, and the superheater 222. In still other embodiments, the heat recovery system 210 can include only one, or alternatively, only two of the preheater 218, the vaporizer 220, and the superheater 222.

In some embodiments, such as the illustrated embodiment of FIGS. 4-9 in which the recuperator 216, the condenser 226, the receiver 228, and the subcooler 230 are enclosed in a single housing 236, connected in a single integral unit, and/or assembled as a unit prior to instillation in a vehicle or a building, the subcooler 230 can be located in the base or lowest portion of the housing 236, the recuperator 216 can be located at one end of the housing 236, the receiver 228 can be located at the opposite end of the housing 236, and the condenser 226 can be located in a central portion of the housing 236. In other embodiments, the recuperator 216, the condenser 226, the receiver 228, and the subcooler 230 can have other orientations and locations within the housing 236. Alternatively or in addition, one or more of the recuperator 216, the condenser 226, the receiver 228, and the subcooler 230 can be located outside the housing.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, while reference is made herein to a heat recovery system 10 having a turbine 24 operable to recover heat energy from engine exhaust 44, the present invention can also or alternately be used with other devices, such as, for example, a thermoelectric (e.g., solid state electronic) device.

What is claimed is:

1. An exhaust gas waste heat recovery heat exchanger comprising:

a housing having a working fluid inlet, a working fluid outlet for dispensing a superheated vapor, an exhaust inlet, and an exhaust outlet;

an exhaust flow path extending through the housing between the exhaust inlet and the exhaust outlet; and a working fluid flow path extending through the housing between the working fluid inlet and the working fluid outlet and having a first portion adjacent to the working fluid inlet and a second portion spaced apart from the working fluid inlet, a flow of working fluid along the first portion of the working fluid flow path being substantially counter to a flow of exhaust along the exhaust flow path adjacent to the first portion of the working fluid flow path, the flow of working fluid along the first portion of the working fluid flow path that is substantially counter to the flow of exhaust is located within the housing to receive heat from the flow of exhaust traveling along the exhaust flow path, the flow of working fluid along the second portion of the working fluid flow path being substantially parallel to the flow of exhaust along the exhaust flow path adjacent to the second portion of the working fluid flow path.

2. The exhaust gas waste heat recovery heat exchanger of claim 1, wherein heat transferred from the flow of exhaust traveling along the exhaust flow path to the working fluid traveling along the second portion of the working fluid flow path vaporizes and superheats the working fluid before the working fluid exits the housing through the working fluid outlet.

3. The exhaust gas waste heat recovery heat exchanger of claim 1, wherein the housing substantially encloses a vaporizer operable to vaporize at least a portion of the flow of working fluid traveling along the second portion of the working fluid flow path, a superheater operable to superheat the flow of working fluid traveling along the second portion of the working fluid flow path, and a preheater positioned along the first portion of the working fluid flow path and being operable to transfer heat from the flow of exhaust to the flow of working fluid traveling along the first portion of the working fluid flow path before the working fluid enters the vaporizer.

4. The exhaust gas waste heat recovery heat exchanger of claim 3, wherein heat is transferred from the exhaust flow to the working fluid flow in at least one of the vaporizer and the superheater before the exhaust flow enters the preheater.

5. The exhaust gas waste heat recovery heat exchanger of claim 3, wherein a bypass extends outwardly from the housing between an outlet of the preheater and an inlet of the vaporizer, the working fluid flow path extending through the bypass.

6. The exhaust gas waste heat recovery heat exchanger of claim 1, wherein the heat exchanger is operable to reduce a temperature difference between the flow of exhaust adjacent the exhaust inlet and the working fluid in the working fluid flow path adjacent to the exhaust inlet.

7. The exhaust gas waste heat recovery heat exchanger of claim 1, wherein the second portion of the working fluid flow path is contained within the housing.

8. The exhaust gas waste heat recovery heat exchanger of claim 1, wherein the first portion of the working fluid flow path extends within a first portion of the housing in counter-flow heat exchange relationship with the flow of exhaust, and wherein the second portion of the working fluid flow path extends within a second portion of the housing in parallel-flow heat exchange relationship with the flow of exhaust.

9. A heat recovery system comprising:

a turbine;

an exhaust gas waste heat recovery heat exchanger including a housing having a working fluid inlet, a working fluid outlet, an exhaust inlet, and an exhaust outlet;

an exhaust flow path extending through the housing between the exhaust inlet and the exhaust outlet; and a working fluid flow path extending through the housing between the working fluid inlet and the working fluid outlet and having a first portion adjacent to the working fluid inlet and a second portion spaced apart from the working fluid inlet, a flow of working fluid along the first portion of the working fluid flow path being substantially counter to a flow of exhaust along the exhaust flow path adjacent to the first portion of the working flow path, the flow of working fluid along the first portion of the working fluid flow path that is substantially counter to the flow of exhaust is located within the housing to receive heat from the flow of exhaust traveling along the exhaust flow path, the flow of working fluid along the second portion of the working fluid flow path being substantially parallel to the flow of exhaust along the exhaust flow path adjacent to the second portion of the working fluid flow path; and a heat transfer circuit extending between a turbine outlet and the working fluid flow path.

10. The heat recovery system of claim 9, wherein heat transferred from the flow of exhaust traveling along the exhaust flow path to the working fluid traveling along the second portion of the working fluid flow path vaporizes and superheats the working fluid before the working fluid exits the housing through the working fluid outlet.

11. The heat recovery system of claim 9, wherein the housing substantially encloses a vaporizer operable to vaporize at least a portion of the flow of working fluid traveling along the second portion of the working fluid flow path, a superheater operable to superheat the flow of working fluid traveling along the second portion of the working fluid flow path, and a preheater positioned along the first portion of the working fluid flow path and being operable to transfer heat from the flow of exhaust to the flow of working fluid traveling along the first portion of the working fluid flow path before the working fluid enters the vaporizer.

12. The heat recovery system of claim 11, wherein heat is transferred from the exhaust flow to the working fluid flow in the vaporizer and the superheater before the exhaust flow enters the preheater.

13. The heat recovery system of claim 11, wherein a bypass extends outwardly from the housing between an outlet of the preheater and an inlet of the vaporizer, the working fluid flow path extending through the bypass.

14. The heat recovery system of claim 9, wherein the heat exchanger is operable to reduce a temperature difference between the flow of exhaust adjacent the exhaust inlet and the working fluid in the working fluid flow path adjacent to the exhaust inlet.

15. The heat recovery system of claim 9, wherein an integrated heat exchanger is positioned along the heat transfer circuit and includes a recuperator having a first pass and a second pass adjacent to the first pass for transferring heat from the working fluid traveling along the first pass to the working fluid traveling along the second pass;

a condenser positioned adjacent to the recuperator to receive the working fluid from the first pass of the recuperator and having a first coolant flow pass for receiving heat from the working fluid traveling through the condenser to condense the working fluid traveling through the condenser;

a housing enclosing the recuperator and the condenser and including a working fluid inlet, a working fluid outlet, a coolant inlet, and a coolant outlet, the first coolant flow pass extending through the housing between the coolant inlet and the coolant outlet.

16. The heat recovery system of claim 15, wherein the integrated heat exchanger includes a subcooler positioned adjacent to the condenser to receive the condensed working fluid from the condenser and having a second coolant flow pass, and wherein the housing encloses the subcooler.

17. The heat recovery system of claim 9, wherein the second portion of the working fluid flow path is contained within the housing.

18. The heat recovery system of claim 9, wherein the first portion of the working fluid flow path extends within a first portion of the housing in counter-flow heat exchange relationship with the flow of exhaust, and wherein the second portion of the working fluid flow path extends within a second portion of the housing in parallel-flow heat exchange relationship with the flow of exhaust.

* * * * *

US008245491C1

(12) EX PARTE REEXAMINATION CERTIFICATE (10028th)

United States Patent
Horek et al.

(10) Number: US 8,245,491 C1
(45) Certificate Issued: Feb. 10, 2014

(54) HEAT RECOVERY SYSTEM AND METHOD

(75) Inventors: Jon Horek, Evanston, IL (US); Michael J. Wilson, Racine, WI (US); Mark Voss, Franksville, WI (US)

(73) Assignee: Modine Manufacturing Company, Racine, WI (US)

Reexamination Request:
No. 90/012,625, Sep. 14, 2012

Reexamination Certificate for:

| | |
|---|---|
| Patent No.: | **8,245,491** |
| Issued: | **Aug. 21, 2012** |
| Appl. No.: | **11/939,906** |
| Filed: | **Nov. 14, 2007** |

Related U.S. Application Data

(60) Provisional application No. 60/859,192, filed on Nov. 15, 2006, provisional application No. 60/860,272, filed on Nov. 21, 2006.

(51) Int. Cl.
*F02C 6/00* (2006.01)

(52) U.S. Cl.
USPC ..... 60/39.182

(58) Field of Classification Search
None
See application file for complete search history.

(56) References Cited

To view the complete listing of prior art documents cited during the proceeding for Reexamination Control Number 90/012,625, please refer to the USPTO's public Patent Application Information Retrieval (PAIR) system under the Display References tab.

*Primary Examiner* — Sara Clarke

(57) ABSTRACT

An exhaust gas waste heat recovery heat exchanger includes a housing having a working fluid inlet, a working fluid outlet, an exhaust inlet, and an exhaust outlet, an exhaust flow path extending through the housing between the exhaust inlet and the exhaust outlet, and a working fluid flow path extending through the housing between the working fluid inlet and the working fluid outlet and having a first portion and a second portion. A flow of working fluid along the first portion of the working fluid flow path can be substantially counter to a flow of exhaust along the exhaust flow path, and the flow of working fluid along the second portion of the working fluid flow path can be substantially parallel to the flow of exhaust along the exhaust flow path.

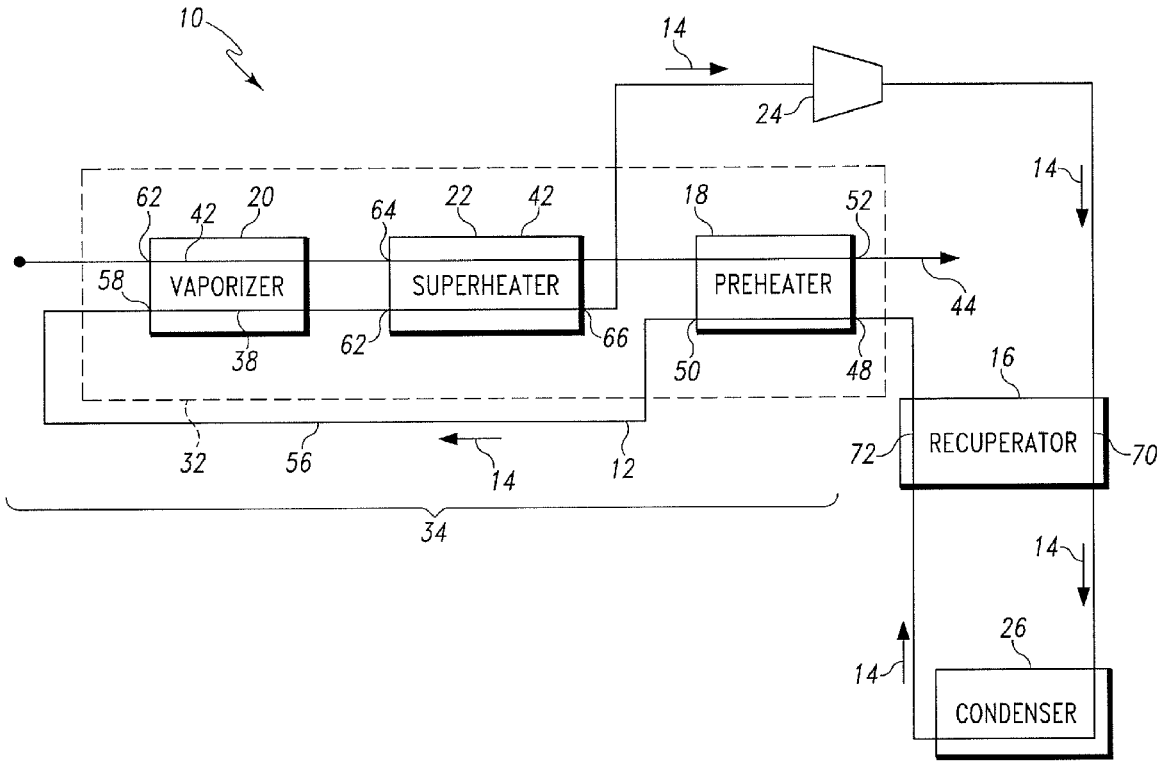

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 9 are determined to be patentable as amended.

Claims 2-8, 10-14, 17 and 18, dependent on an amended claim, are determined to be patentable.

Claims 15 and 16 were not reexamined.

1. An exhaust gas waste heat recovery heat exchanger comprising:

a housing having a working fluid inlet, a working fluid outlet for dispensing a superheated vapor, an exhaust inlet, and an exhaust outlet;

an exhaust flow path extending through the housing between the exhaust inlet and the exhaust outlet; and a working fluid flow path extending through the housing between the working fluid inlet and the working fluid outlet and having a first portion adjacent to the working fluid inlet and a second portion spaced apart from the working fluid inlet, a flow of working fluid along the first portion of the working fluid flow path being substantially counter to a flow of exhaust along the exhaust flow path adjacent to the first portion of the working fluid flow path, the flow of working fluid along the first portion of the working fluid flow path that is substantially counter to the flow of exhaust is located within the housing to receive heat from the flow of exhaust traveling along the exhaust flow path, the flow of working fluid along the second portion of the working fluid flow path being substantially parallel to the flow of exhaust along the exhaust flow path adjacent to the second portion of the working fluid flow path,

*wherein the housing includes a wall extending from the exhaust inlet to the exhaust outlet, wherein heat transfer between the flow of exhaust and the flow of working fluid occurs through the wall, and wherein the exhaust inlet is located at a first end of the housing and the exhaust outlet is located at a second end of the housing opposite from the first end.*

9. A heat recovery system comprising:

a turbine;

an exhaust gas waste heat recovery heat exchanger including a housing having a working fluid inlet, a working fluid outlet, an exhaust inlet, and an exhaust outlet;

an exhaust flow path extending through the housing between the exhaust inlet and the exhaust outlet; and a working fluid flow path extending through the housing between the working fluid inlet and the working fluid outlet and having a first portion adjacent to the working fluid inlet and a second portion spaced apart from the working fluid inlet, a flow of working fluid along the first portion of the working fluid flow path being substantially counter to a flow of exhaust along the exhaust flow path adjacent to the first portion of the working flow path, the flow of working fluid along the first portion of the working fluid flow path that is substantially counter to the flow of exhaust is located within the housing to receive heat from the flow of exhaust traveling along the exhaust flow path, the flow of working fluid along the second portion of the working fluid flow path being substantially parallel to the flow of exhaust along the exhaust flow path adjacent to the second portion of the working fluid flow path; and a heat transfer circuit extending between a turbine outlet and the working fluid flow path,

*wherein the housing includes a wall extending from the exhaust inlet to the exhaust outlet, wherein heat transfer between the flow of exhaust and the flow of working fluid occurs through the wall, and wherein the exhaust inlet is located at a first end of the housing and the exhaust outlet is located at a second end of the housing opposite from the first end.*

* * * * *